US007014292B2

(12) United States Patent
Yazawa et al.

(10) Patent No.: US 7,014,292 B2
(45) Date of Patent: Mar. 21, 2006

(54) INK JET RECORDING APPARATUS

(75) Inventors: Takeshi Yazawa, Kanagawa (JP); Hiroshi Tajika, Kanagawa (JP); Yuji Konno, Kanagawa (JP); Daisaku Ide, Tokyo (JP); Atsuhiko Masuyama, Kanagawa (JP); Akiko Maru, Kanagawa (JP); Hirokazu Yoshikawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 203 days.

(21) Appl. No.: 10/648,300

(22) Filed: Aug. 27, 2003

(65) Prior Publication Data

US 2004/0041875 A1 Mar. 4, 2004

(30) Foreign Application Priority Data

Aug. 29, 2002 (JP) ..... 2002-250764

(51) Int. Cl.
*B41J 2/165* (2006.01)

(52) U.S. Cl. ..... 347/29; 347/23

(58) Field of Classification Search ..... 347/22–36
See application file for complete search history.

(56) References Cited

U.S. PATENT DOCUMENTS

| | | | | |
|---|---|---|---|---|
| 6,145,956 | A | 11/2000 | Koitabashi et al. | 347/30 |
| 6,837,566 | B1 * | 1/2005 | Mitsuzawa et al. | 347/23 |
| 2002/0085062 | A1 | 7/2002 | Ide et al. | 347/33 |

OTHER PUBLICATIONS

U.S. Appl. No. 09/956,790 (Otsuka et al.), filed Sep. 21, 2001.
U.S. Appl. No. 10/640,048 (Edamura et al.), filed Aug. 14, 2003.

* cited by examiner

*Primary Examiner*—Stephen Meier
*Assistant Examiner*—Ly T. Tran
(74) *Attorney, Agent, or Firm*—Fitzpatrick, Cella, Harper & Scinto

(57) ABSTRACT

An ink jet recording apparatus is structured to perform discharges in the capping status when preliminary discharges are performed in a shot number larger than a predetermined number, and perform discharges in a cap or a preparatory port other than the cap when the preliminary discharges are performed in a shot number less than the predetermined number. With the structure thus arranged, it is made possible to implement the suppression of the mist generation due to the preliminary discharges, and to make the time of recording on a recording medium shorter as well.

7 Claims, 13 Drawing Sheets

| NAME | NUMBER OF PRE-EJECTIONS | EJECTION FREQUENCY | TIMING | PRE-EJECTION POSITION |
|---|---|---|---|---|
| PRE-EJECTION A1 | (500) | 9kHz | BEFORE START OF RECORDING [1] (0H ≤ [1] < 12H) | CAP (OPEN) |
| PRE-EJECTION A2 | (700) | 9kHz | BEFORE START OF RECORDING [2] (12H ≤ [2] < 24H) | CAP (CLOSE) |
| PRE-EJECTION A3 | (1000) | 9kHz | BEFORE START OF RECORDING [3] ([3] ≥ 24H) | CAP (CLOSE) |
| PRE-EJECTION B1 | (9) | 9kHz | ON RECORDING | PREPARATORY PORT OR CAP (OPEN) |
| PRE-EJECTION B2 | (9) | 9kHz | ON SUSPENDED RECORDING, ETC | PREPARATORY PORT OR CAP (OPEN) |
| PRE-EJECTION C | (500) | 9kHz | AFTER WIPING | CAP (OPEN) |
| PRE-EJECTION D | (20000) | 1.3kHz | AFTER SUCTION OPERATION | CAP (CLOSE AND IDLE SUCTION) |

FIG. 6

| NAME | NUMBER OF PRE-EJECTIONS | EJECTION FREQUENCY | TIMING | PRE-EJECTION POSITION |
|---|---|---|---|---|
| PRE-EJECTION A1 | (500) | 9kHz | BEFORE START OF RECORDING [1] ($0H \leq [1] < 12H$) | CAP (OPEN) |
| PRE-EJECTION A2 | (700) | 9kHz | BEFORE START OF RECORDING [2] ($12H \leq [2] < 24H$) | CAP (OPEN) |
| PRE-EJECTION A3 | (1000) | 9kHz | BEFORE START OF RECORDING [3] ($[3] \geq 24H$) | CAP (OPEN) |
| PRE-EJECTION B1 | (9) | 9kHz | ON RECORDING | PREPARATORY PORT OR CAP (OPEN) |
| PRE-EJECTION B2 | (9) | 9kHz | ON SUSPENDED RECORDING, ETC | PREPARATORY PORT OR CAP (OPEN) |
| PRE-EJECTION C | (500) | 9kHz | AFTER WIPING | CAP (OPEN) |
| PRE-EJECTION D | (20000) | 1.3kHz | AFTER SUCTION OPERATION | CAP (CLOSE AND IDLE SUCTION) |

FIG. 7

| NAME | NUMBER OF PRE-EJECTIONS | EJECTION FREQUENCY | TIMING | PRE-EJECTION POSITION |
|---|---|---|---|---|
| PRE-EJECTION A1 | (500) | 9kHz | BEFORE START OF RECORDING [1] ($0H \leq [1] < 12H$) | CAP (OPEN) |
| PRE-EJECTION A2 | (700) | 9kHz | BEFORE START OF RECORDING [2] ($12H \leq [2] < 24H$) | CAP (CLOSE) |
| PRE-EJECTION A3 | (1000) | 9kHz | BEFORE START OF RECORDING [3] ($[3] \geq 24H$) | CAP (CLOSE) |
| PRE-EJECTION B1 | (9) | 9kHz | ON RECORDING | PREPARATORY PORT OR CAP (OPEN) |
| PRE-EJECTION B2 | (9) | 9kHz | ON SUSPENDED RECORDING, ETC | PREPARATORY PORT OR CAP (OPEN) |
| PRE-EJECTION C | (500) | 9kHz | AFTER WIPING | CAP (OPEN) |
| PRE-EJECTION D | (20000) | 1.3kHz | AFTER SUCTION OPERATION | CAP (CLOSE AND IDLE SUCTION) |

INK JET RECORDING APPARATUS

BACKGROUND OF THE INVENTION

1. Field of the Invention

The present invention relates to an ink jet recording apparatus that performs recording by discharging ink from recording means to a recording medium.

2. Related Background Art

Conventionally, the recording apparatus that records on a recording medium, such as paper, cloth, plastic sheet, or OHP sheet, among some other materials (hereinafter, also, simply referred to as a "recording sheet"), has been proposed in a mode in which a recording head of wire-dot method, thermal sensitive method, thermal transfer method, ink jet method, or the like is made mountable thereon, for example.

Of such recording apparatuses, the one that adopts an ink jet recording method for recording on a recording sheet by discharging ink from the ink discharge ports (hereinafter, referred to as an ink jet recording apparatus) is of non-impact type, which produces a lesser amount of noise, and makes it possible to perform a recording operation in high density at high speed. Generally, the ink jet recording apparatus is provided with means for driving a carriage having the recording head mounted thereon; conveying means for conveying a recording sheet; and control means for controlling them.

Meanwhile, as the energy-generating element that generates energy to be utilized for discharging ink from the ink discharge ports of a recording head, there is the one that uses an electromechanical converting element, such as a piezo-element, the one that generates heat by irradiating electromagnetic waves to thereby discharge ink droplets, such as a laser, or the one that heats liquid by use of an electrothermal converting element provided with a heat-generating resistor member, among some others.

Of the recording heads of such kinds, the recording head of the ink jet recording method that discharges ink as liquid droplets by the utilization of thermal energy makes it possible to perform recording in high resolution, because the ink discharge ports can be arranged in high density. Among them, the recording head that uses electrothermal converting elements as energy-generating elements has such advantage as to realize miniaturization with ease, which can be manufactured and assembled in high density at lower manufacturing costs by the full utilization of the advantages of the IC technologies and techniques, and micro-processing art having made remarkable technical advancement and the enhancement of reliability in the semiconductor field in recent years.

As described above, the ink jet recording method makes an extremely excellent recording performance possible with a simple structural arrangement. On the other hand, however, there also exist problems yet to be solved.

As the problems of the ink jet recording method, the scratches or unprinted lines of recorded images and the increased density of ink may be encountered due to the evaporation of ink from discharge ports, or the various ink colors may intermix in the discharge ports after the execution of the suction recovery operation, among some other causes. In order to solve these problems, it is generally practiced to perform the so-called preparatory discharges, which are the discharges not related to the image formation. More specifically, the predetermined preparatory discharges are effectuated in the preparatory ports or in a cap, based on the time that has elapsed since the last performance of the preparatory discharge or based on the time that has elapsed since the previous capping. Then, it is known that the number of preparatory discharges is made different in accordance with the time that has elapsed since the last preparatory discharge or the time that has elapsed since the last capping.

Also, in the specification of U.S. Pat. No. 5,701,146, there is the disclosure as to an art whereby to suck and exhaust ink in the cap under the atmosphere, while executing preparatory discharges in the cap, in order to enhance the recovery capability of a recording head or the surface of a recording head.

However, it is known that when preliminary discharges are performed, there tends to occur the phenomenon that there are floating in the apparatus the fine ink droplets that accompany ink droplets discharged or the fine ink droplets generated by part of rebounded ink droplets which are landed onto the cap, or, further, the discharged ink droplets themselves, which makes flying speed slower before the droplets are impacted, due to the influence of air resistance or the like. The ink droplets and others that float in the apparatus are collectively called "mist", and if there is the floating of a considerable amount of mist, the adhesion thereof occurs on the components in the apparatus, leading to various kinds of drawbacks eventually. If a considerable amount of mist adheres to the parts, which are in contact with a recording medium, the recording medium is stained, and if the surface thereof is stained, it results even in the degradation of recording quality. Also, if a considerable amount of mist adheres to the parts, such as an optical sensor, it becomes impossible to carry out exact detection, leading to the operational drawback, and the degradation of recording quality may ensue or the recording apparatus is caused to be out of order in some cases. Also, if a considerable amount of mist adheres to the parts that the user may handle, his hand may be stained unavoidably.

Here, it is known that in order to suppress the mist generation of such kind, preliminary discharges are performed in the status of having the cap capped to the discharge port surface of the recording head, which cap is usually used for the prevention of ink evaporation from the discharge ports. Nevertheless, although it becomes possible to suppress the mist generation by the performance of preliminary discharges in the status where the discharge port surface is capped, there is a problem that the time of recording on a recording medium takes more time, because it requires a time to execute the capping operation to enable the cap to be in contact with the discharge port surface.

SUMMARY OF THE INVENTION

The present invention is designed to solve the problems discussed above. It is an object of the invention to provide an ink jet recording apparatus capable of suppressing the drawback that may be brought about by the generation of mist, while attempting making the time of recording on a recording medium shorter.

In order to achieve this object, the ink jet recording apparatus of the present invention, which performs image formation on a recording medium by using a recording head having plural discharge ports being arranged to discharge ink from the discharge ports, comprises preliminary discharging means for performing preliminary discharges by discharging ink from the discharge ports irrespective of the image formation; capping means for enabling a cap for capping the plural discharge ports to be in contact with and retract from the discharge port surface of the recording head where the discharge ports are formed; and selection means for selecting whether the preliminary discharges are performed in the status of having the cap in contact with the discharge port surface or in the status of having the cap away from the discharge port surface, according to the number of ink discharges by the preliminary discharging means, wherein the ink discharge number in the status of having the cap in contact is made larger than the ink discharge number in the status of having the cap away.

Also, the ink jet recording apparatus of the present invention, which performs image formation on a recording medium by using a recording head having plural discharge ports being arranged to discharge ink from the discharge ports, comprises preliminary discharging means for performing preliminary discharges by discharging ink from the discharge ports irrespective of the image formation; capping means for enabling a cap for capping the plural discharge ports to be in contact with and retract from the discharge port surface of the recording head where the discharge ports are formed; and selection means for selecting whether suction by suction means and the preliminary discharges are performed in the status of having the cap in contact with the discharge port surface and having the inside of the cap communicated with the air outside, the preliminary discharges are performed in the status of having the cap in contact with the discharge port surface, or the preliminary discharges are performed in the status of having the cap away from the discharge port surface according to the number of ink discharges by the preliminary discharging means, where the ink discharge number of the suction and the preliminary discharges being performed in the status of having the cap in contact is made larger than the ink discharge number of the preliminary discharges being performed in the status of having the cap in contact, and the ink discharge number of the preliminary discharges being performed in the status of having the cap in contact is made larger than the ink discharge number in the status of having the cap away.

Also, the ink jet recording apparatus of the present invention, which performs image formation on a recording medium by using a recording head having plural discharge ports arranged to discharge ink from the discharge ports, comprises preliminary discharging means for performing preliminary discharges by discharging ink from the discharge ports irrespective of the image formation; capping means for enabling a cap for capping the plural discharge ports to be in contact with and retract from the discharge port surface of the recording head where the discharge ports are formed; and preliminary discharge control means for controlling the preliminary discharging means to selectively perform the plurality of preliminary discharges having different discharge numbers of the ink, said control means controlling the preliminary discharge operations corresponding to the performance of the preliminary discharges in the status of having the cap in contact with the discharge port surface or to the performance of the preliminary discharges in the status of having the cap away from the discharge port surface per plurality of the preliminary discharge operations.

In accordance with the present invention, the following effect is demonstrated:

The invention is so structured that based on the idea that the influence exerted by the mist generation is small when the number of preliminary discharges is small, the preliminary discharges are performed in the status of having the cap away, and based on the idea that the influence exerted by the mist generation is large when the number of preliminary discharges is large, the preliminary discharges are performed in the capping status. Thus, with the execution of preliminary discharges using plural modes of preliminary discharges corresponding to the status of the recording apparatus, it is made possible to provide an ink jet recording apparatus capable of suppressing the drawback resulting from the mist generation, while implementing the recording on a recording medium in a shorter period of time.

BRIEF DESCRIPTION OF THE DRAWINGS

FIG. 6 is a table that indicates a preparatory-discharge mode in accordance with a first embodiment.

FIG. 7 is a table that indicates a preparatory-discharge mode in accordance with a second embodiment.

DETAILED DESCRIPTION OF THE PREFERRED EMBODIMENTS

FIRST EMBODIMENT

Figure 1:
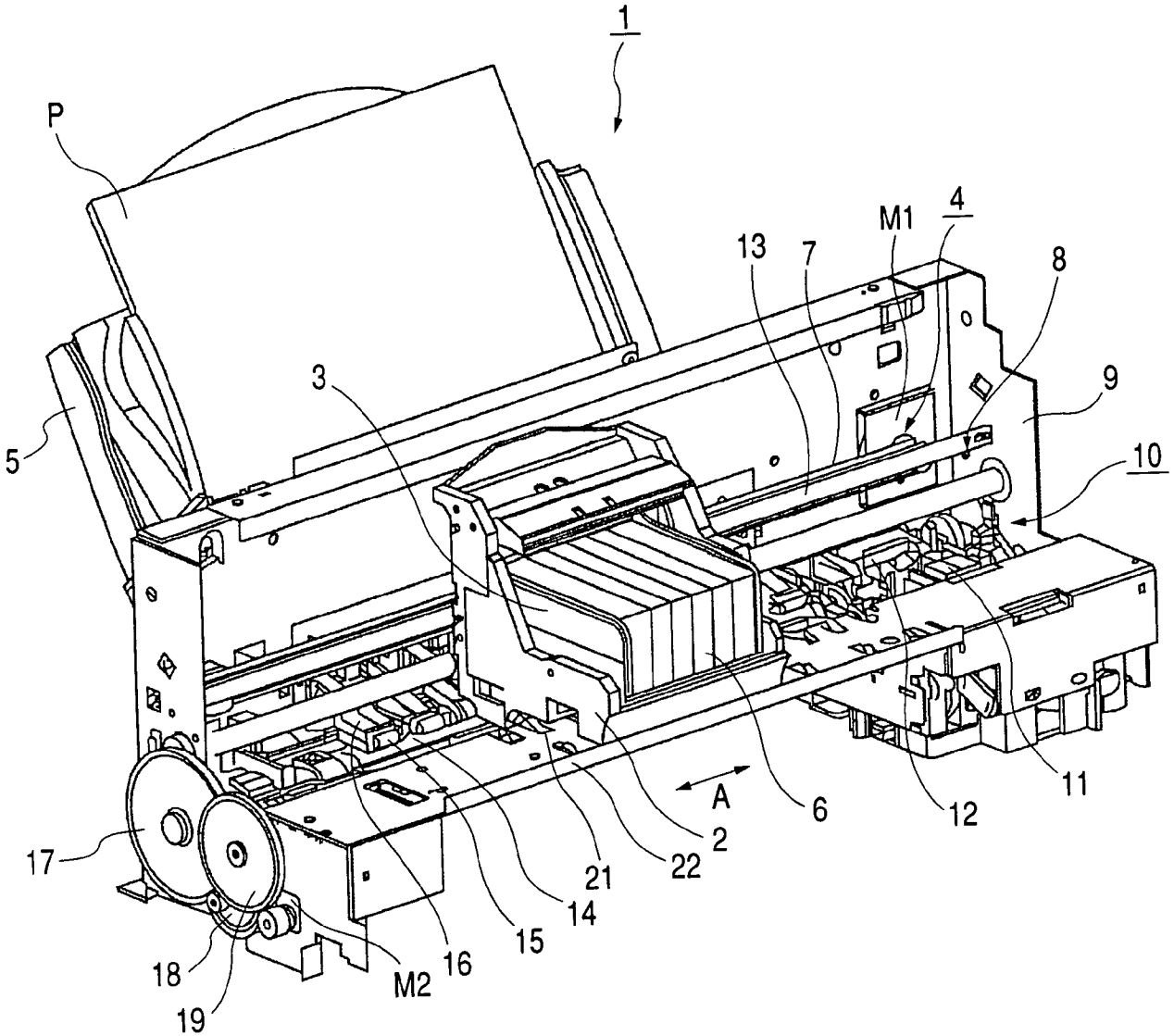
FIG. 1 is a perspective view that schematically shows the inner side of an ink jet recording apparatus provided with a discharge recovery device.
Figure 2:
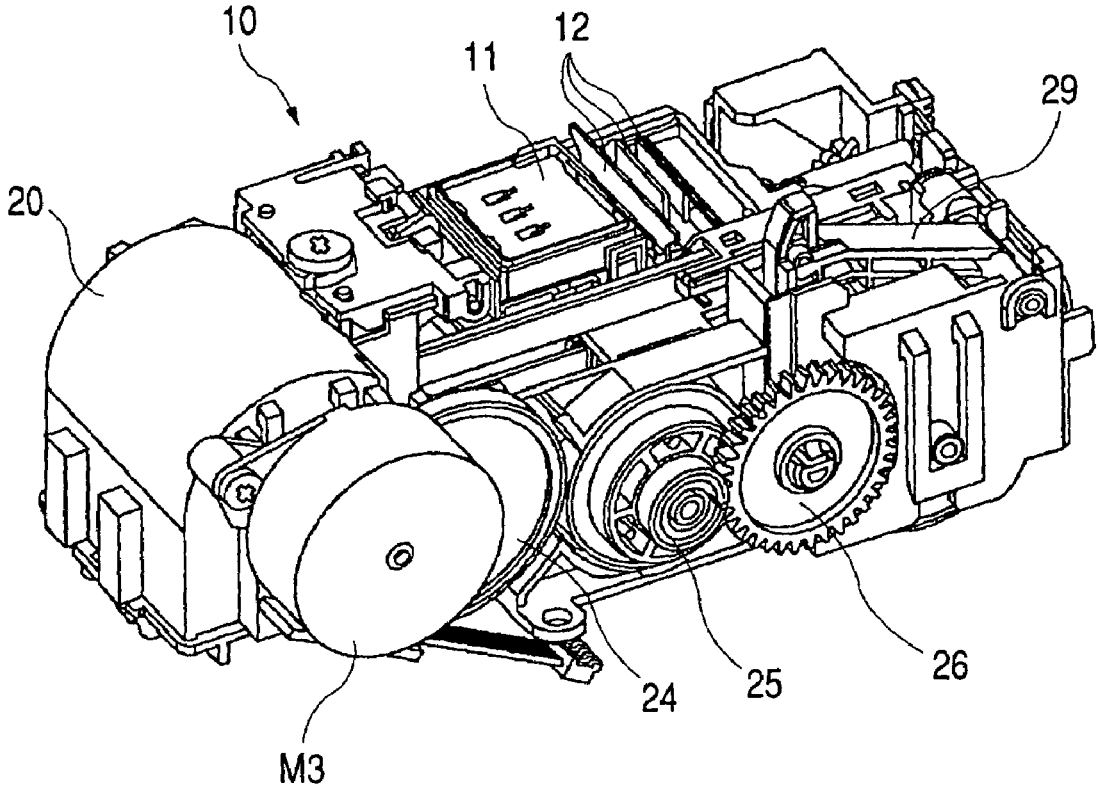
FIG. 2 is a perspective view that schematically shows the discharge recovery device of an ink jet recording apparatus.
Figure 3:
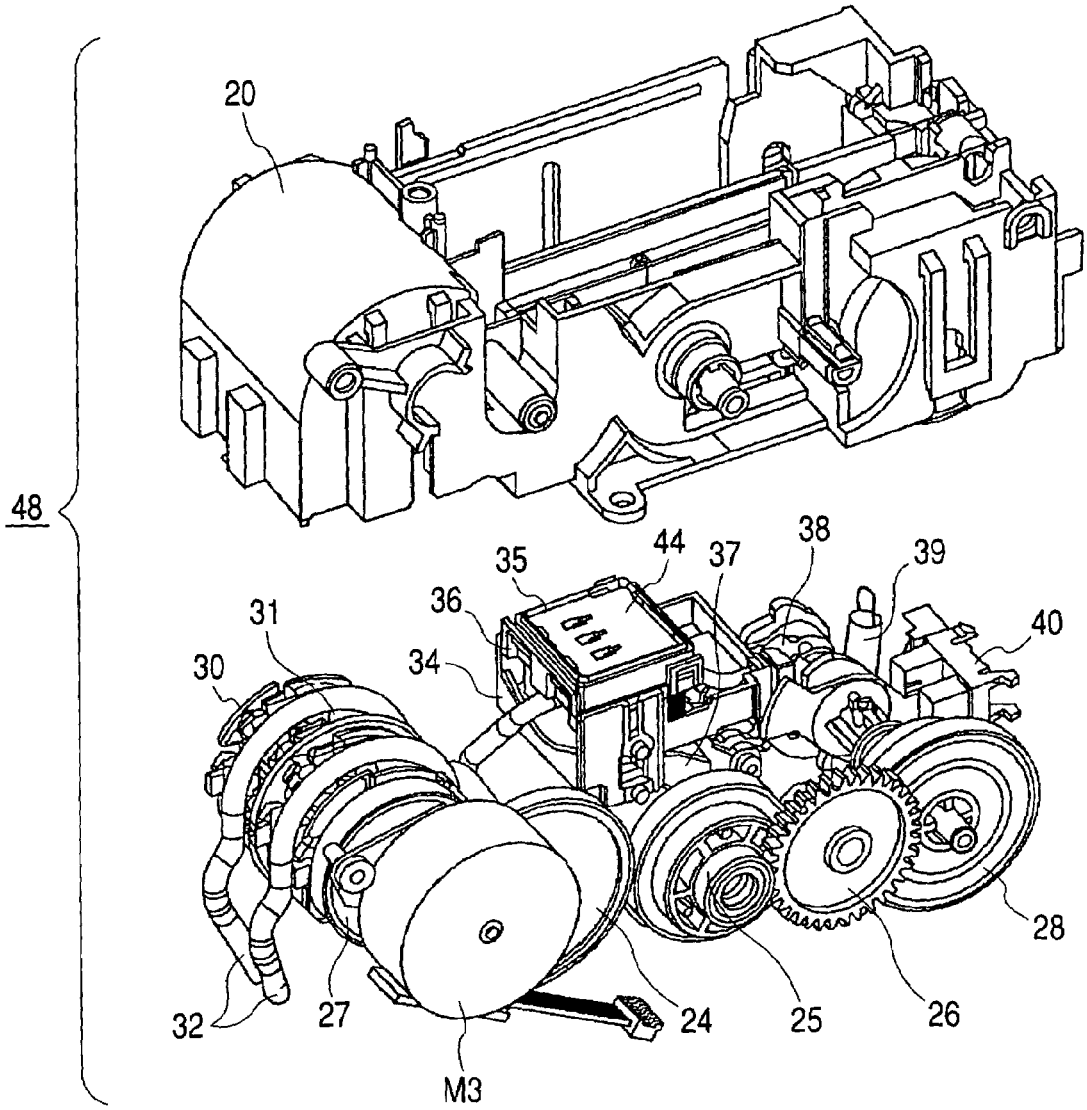
FIG. 3 is an exploded perspective view that schematically shows the inner structure of the discharge recovery device of the ink jet recording apparatus represented in FIG. 2.

Hereinafter, with reference to the accompanying drawings, a first embodiment will be described in accordance with the present invention. In this respect, the same reference marks are applied to the same or corresponding parts throughout each of the drawings. FIG. 1 is a perspective view that schematically shows the inner side of an ink jet recording apparatus provided with a discharge recovery device. FIG. 2 is a perspective view that schematically shows the discharge recovery device of the ink jet recording apparatus represented in FIG. 1. FIG. 3 is an exploded perspective view that schematically shows the inner structure of the discharge recovery device of the ink jet recording apparatus of the present invention (the ink jet recording apparatus represented in FIG. 1).

In FIG. 1 to FIG. 3, the ink jet recording apparatus 1 is provided with a driving motor M serving as the driving source; a carriage 2 having the ink jet recording head 3 mounted thereon; a power transmission mechanism 4 that enables the carriage 2 to reciprocate by use of the driving motor M1 in the direction indicated by a double-headed arrow A; a sheet-feeding mechanism (sheet conveyance mechanism) 5 that conveys (carries) a recording sheet P serving as the recording medium; and a discharge recovery device (the discharge recovery device) 10 that maintains the discharge port surface for performing the discharge recovery process of the recording head 3. In the ink jet recording apparatus 1 of such kind, the recording sheet P is conveyed by the sheet-feeding mechanism 5 for the execution of a designated recording by use of the recording head 3 on the recording sheet P. The ink jet cartridge 6 mounted on the carriage 2 is detachably held (installed) on the carriage 2 that is the member for mounting the recording head thereon. To the recording head 3, ink contained in the ink jet cartridge 6 is supplied. In this case, the carriage 2 and the recording head 3 are arranged so that the bonding faces of both of them are appropriately in contact to attain and maintain the electrical connection as required. The recording head 3 is an ink jet recording head that discharges ink selectively from plural discharge ports when energy is applied to the recording head in accordance with electric signals. Also, the recording head 3 is ink jet recording means for discharging ink by the utilization of thermal energy, and provided with electrothermal converting elements for generating thermal energy. Further, the recording head 3 performs recording by discharging ink from discharge ports by the utilization of the pressure changes made by the development and shrinkage of bubbles brought about by film boiling generated by thermal energy applied by the electrothermal converting element. Each of the discharge ports is arranged corresponding to the electrothermal converting element, respectively, and ink is discharged from each of the discharge ports by the application of pulse voltage to the corresponding electrothermal converting element in accordance with recording signals.

Figure 16:
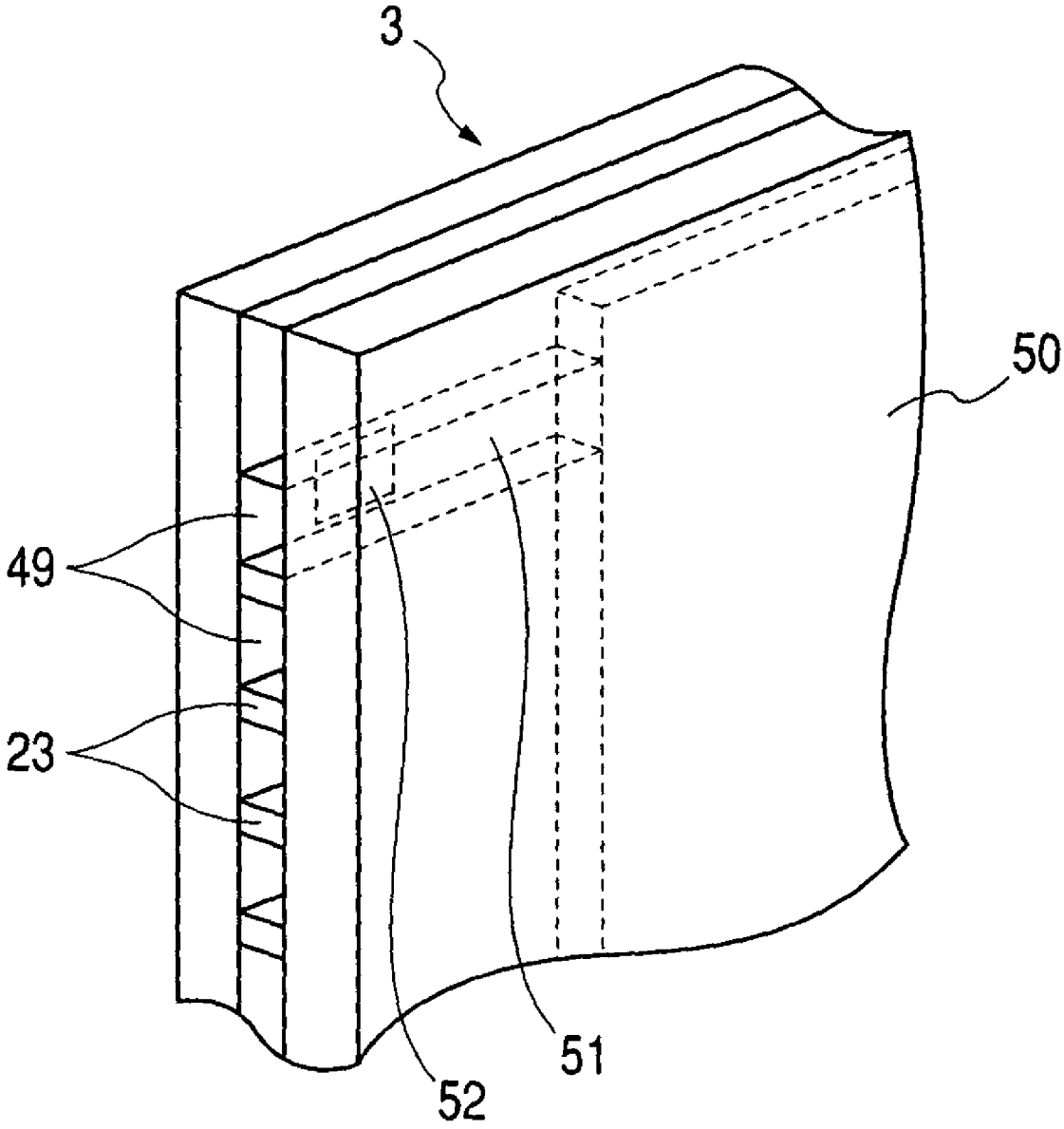
FIG. 16 is a partial perspective view that shows schematically the structure of the ink discharge portion of recording means represented in FIG. 1.

FIG. 16 is a partial perspective view that shows schematically the structure of the ink discharge portion (one discharge port array) of recording means (recording head) 3. In FIG. 16, plural discharge ports 49 are formed at designated pitches for the discharge port surface 23, which is provided to face a recording medium (recording sheet or the like) P with a predetermined gap (approximately 0.3 to 2.0 mm, for example), and the electrothermal converting element (heat-generating resistor member or the like) 52 for generating energy used for discharging ink is arranged along the wall face of each liquid flow path 51 that enables the common liquid chamber 50 and each discharge port 49 to be communicated. The recording head 3 is guided and supported in the positional relations with which to arrange the discharge ports 49 in the direction intersecting with the main scanning direction (the traveling directions of the carriage 2 indicated by the double-headed arrow A in accordance with the present embodiment wherein the recording head is mounted on the carriage 2). Thus, the corresponding electrothermal converting element 52 is driven (by the application of pulse voltage) in accordance with image signals or discharge signals so as to cause ink film boiling in the liquid path 51. Recording means (recording head) 3 is thus structured to discharge ink droplets from each of the discharge ports by pressure exerted at that time.

In FIG. 1, the carriage 2 is connected with a part of the driving belt 7 of the power transmission mechanism 4 that transmits the driving power of the driving motor M1, and guided and supported slidably by the guide shaft 13 in the directions indicated by the double-headed arrow A. Hence the carriage is installed to be driven by means of the aforesaid driving motor M1. Therefore, the carriage 2 reciprocates along the guide shaft 13 in accordance with the regular and reverse rotations of the driving motor M1. Also, a reference numeral 8 designates the scale that indicates the absolute portion of the carriage 2 in the directions indicated by the double-headed arrow A. The scale used for the present embodiment is formed by transparent PET film having black bars printed at the pitches that serve the purpose. The one end thereof is fixed to the chassis 9, and the other end is supported by a flat spring (not shown). For the ink jet recording apparatus 1 shown in FIG. 1, a platen (not shown) is provided to face the discharge port surface of the recording head 3 having discharge ports (not shown) formed therefor. At the same time that the carriage 2 with the recording head 3 mounted thereon reciprocates by the driving power of the driving motor M1, recording signals are transmitted to the recording head 3 for discharging ink. Thus, recording is made on the entire width of the recording sheet P that serves as the recording medium to be conveyed on the platen.

A reference numeral 14 designates the conveying roller, which is driven by the conveying motor M2 for conveying the recording sheet; 15, the pinch roller to be in contact with the conveying roller 14 by means of a spring (not shown); and 16, the pinch roller holder, which rotatively supports the pinch roller 15.

Also, a reference numeral 17 designates the conveying roller gear, which is fixed to one end of the conveying roller 14, and enables the conveying roller 14 to rotate by the rotation of the conveying motor M2 transmitted to the conveying roller gear 17 through an intermediate gear 18; 19, the expeller roller gear, which is fixed to an expeller roller (not shown) used for expelling the recording sheet out of the recording apparatus after images are formed by the recording head 3, and the expeller roller is driven by the rotation of the conveying motor M2 transmitted to the expeller roller gear 19 through the intermediate gear 18. In this respect, a reference numeral 21 designates the spur roller, which enables the recording sheet to be in contact with the expeller roller under pressure by use of a spring (not shown); and 22, the spur roller holder that supports the spur roller 21 rotatively.

Also, for the ink jet recording apparatus 1 of such kind, it is practiced to arrange a discharge recovery device for restoring discharge defects of the recording head 3 in a desired position (a position facing the home position, for example) outside the range of the reciprocation of the carriage 2 mounted on the recording head 3 (outside the recording area) for performing the recording operation. The discharge recovery device of such kind is generally provided with capping means 11 for capping the discharge port surface of the recording head 3, and wiping means 12 for cleaning the discharge port surface of the recording head 3. Then, interlocked with the capping of the discharge port surface effectuated by the capping means 11, suction means (a suction pump or the like) 48 provided in the discharge recovery device forcibly exhausts ink from the discharge ports. In this manner, overly viscous ink or bubbles in the ink flow paths of the recording head 3 are removed or some other discharge recovery process is executed. Also, at the time of non-recording or the like, the discharge port surface of the recording head 3 is capped to protect the recording head, while preventing ink from being dried. Also, the wiping means 12 is arranged near the capping means 11, while it is arranged to wipe off ink droplets adhering to the discharge port surface of the recording head 3. Then, with capping means 11 and wiping means 12, it is made possible to maintain the recording head 3 in the normal condition.

Figure 4:
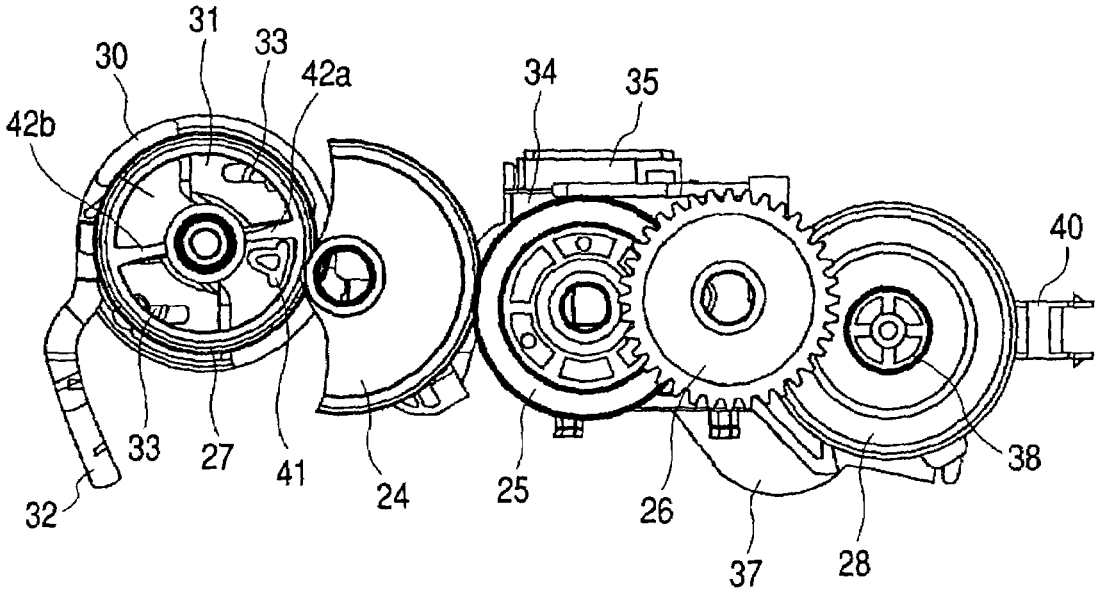
FIG. 4 is a side view that schematically shows the inner-structure driving gear train of the discharge recovery device (including a partly broken part).

Now, in conjunction with FIG. 2, FIG. 3, and FIG. 4, the description will be made of the structure of the discharge recovery device in accordance with the present invention. The discharge recovery device is provided with suction means 48, capping means 11, and wiping means 12 as means for recovering the discharge defects of the recording head 3 or the like.

For the suction means 48, there are arranged two suction tubes 32 along the arc of the inner face of circular recovery base 20 serving as the guiding surface for them. Here, the pressure roller 33, which generates negative pressure in the suction tubes 32 by depressing the suction tubes 32 by use of a pressure spring (not shown), is axially supported in an elongated hole provided for the pressure roller holder 31 so that the pressure roller may be on the depressing side when it is engaged in the suction operation for the generation of negative pressure in the suction tube 32 and the pressure roller may retract from the suction tubes 32 when it is not engaged in the suction operation. In this respect, two pressure rollers are arranged for one suction tube 32. In accordance with the present embodiment, the circular surface of the recovery base 20 that guides the suction tubes 32 is semicircular, and then, the pressure rollers 33 are arranged to face each other at 180 degrees to make the continuous operation of suction possible by the two pressure rollers 33, while keeping the inside of the suction tubes negatively pressurized by rotating two pressure rollers 33 continuously in such a manner that when one pressure roller retracts from depressing the suction tubes 32, the other pressure roller 33 depresses the suction tubes 32. Also, in a case where the guiding configuration is almost circular, it may be possible to obtain the same effect even by use of only one pressure roller. Further, even in a case where the guiding configuration is semicircular, it is possible to execute the suction operation continuously if two or more pressure rollers are provided. The aforesaid pressure roller holder 31 is axially supported to the pressure roller holder guide 30 rotatively in the radial direction of the circular guide face of the recovery base 20, and then, functions to enable the pressure rollers 33 to depress the suction tubes 32 or to retract from them. The pressure roller guide 30 is provided with shafts at both ends thereof, and axially supported at the center of the arc of the semicircular guide face of the recovery base 20, which is provided with the suction tubes 32, and arranged to be rotative with the transmission of the driving power of a driving motor (which is called a PG motor) M3. The driving power from the PG motor M3 is transmitted to suction means 48 through the PG gear-a 24 and the pump gear 27 and enables the rotational shaft of the pressure roller holder guide 30 to axially support the pump gear 27, and further, it is transmitted when the pump gear trigger boss 41 arranged on one end face of the pressure roller guide 30 abuts against the pump gear trigger ribs 42*a* and 42*b* by the rotation of the pump gear 27. Here, to add the description of the configuration of the pump gear 27, two ribs are provided for the inside of the pump gear 27 (the pump gear trigger rib a 42*a*, and the pump gear trigger rib b 42*b*), and the structure is arranged so that space is provided for the side face, and when the boss (pump trigger boss 41) enters such space and abuts against both ribs, the driving power is transmitted to the suction means 48 side. Also, the suction means 48 is formed to be directly connected with the PG motor M3, and the structure is arranged so that the rotation of the PG motor M3 in one direction (hereinafter referred to as the regular rotation) enables the suction operation to be made, and in the opposite direction (hereinafter referred to as the reverse rotation), it enables the pressure rollers 33 to move from the status of depressing the suction tubes 32 in the direction toward releasing the depression.

Figure 10:
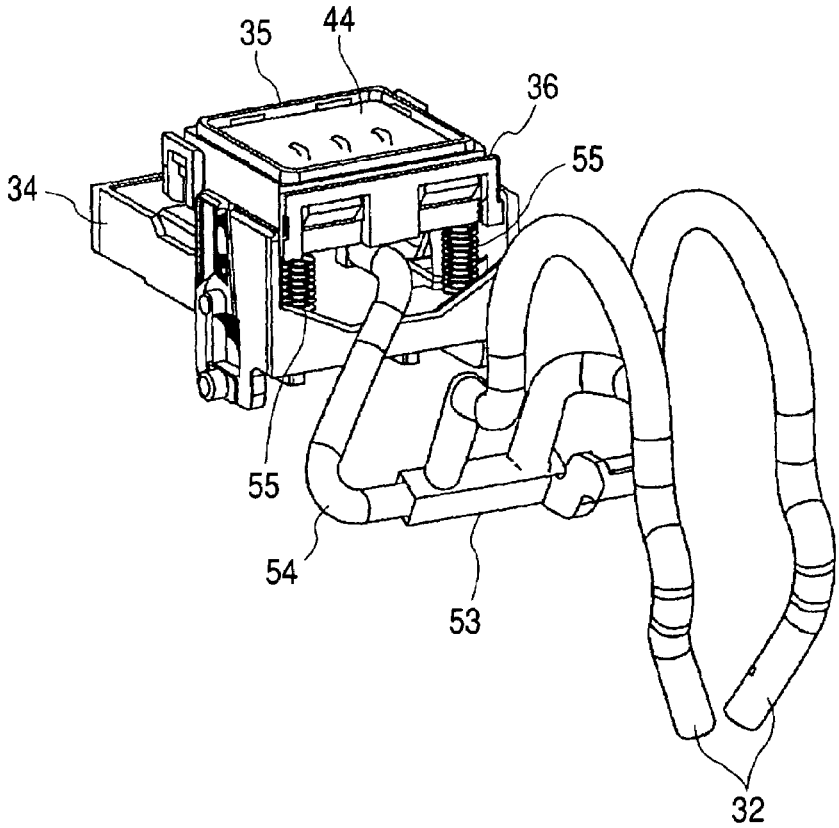
FIG. 10 is a perspective view that shows schematically the structure of the cap unit of the discharge recovery device.

Capping means 11 is structured by a cap member 35 (hereinafter simply referred to as a "cap") that abuts against the discharge port surface of the recording head 3; a cap absorbent 44 shown in FIG. 10 for efficiently sucking ink exhausted from the discharge port surface of the recording head 3; the cap holder 36, which is capable of supporting and keeping the cap 35 in contact with the discharge port surface of the recording head 3 using a cap spring; the cap spring 55, which gives the cap holder 36 the capping pressure; the cap base 34, which supports the cap spring 55, and also, slidably supports the cap holder 36 in the upward and downward directions; a capping means-lifting lever 37 that serves as an arm member for enabling the cap 35 to be in contact with or away from the discharge port surface of the recording head 3; an air ventilation tube 45 connected with air ventilation hole 47, which is provided for the cap 35 and the cap base 34 as shown in FIG. 10 to FIG. 15; and air ventilation valve 46, which is capable of producing the air-tight condition or released condition inside the cap 35 by opening and closing the air ventilation hole 47.

The two suction tubes 32 that form suction means 48 are integrated as one connecting tube 54 by use of a tube joint 53, and connected with capping means 11 by way of the cap holder 36. The structure is then arranged to be able to suck ink from the recording head 3 by the suction operation of suction means 48 that exerts negative pressure inside the cap 35 during the period of the capping means being in contact with the discharge port surface of the recording head 3.

In accordance with the present embodiment, there are arranged inside the cap 35 the cap absorbent 44, the air ventilation tube 45, and the air ventilation valve 46. Then, the structure is arranged so that the lifting operation of the capping means 11, which is needed for enabling it to abut against the recording head 3, and the opening and closing operation of the air ventilation valve 46 are executed by receiving the driving power of the PG motor M3 transmitted through the one-way clutch gear 28, which engages with the cam 38 that implements the lifting operation of the capping means 11, as well as the opening and closing operation of the air ventilation valve 46 by rotating in the one-way direction with the driving power thus transmitted from the PG motor M3 through the PG gear-b 25 and the PG gear-c 26.

The one-way clutch gear 28 does not transmit the driving power to the cam 38 with the idle rotation in the other direction.

Besides the operation of the capping means, the cam 38 is arranged to be able to drive wiping means 12, and also, to control the lifting operation of the CR lock lever 29 provided for positioning between the capping means 11 which constitutes the discharge recovery device in the present embodiment, and the recording head 3, during the recovery operation of the recording head 3. Here, by use of the cam-position detection sensor flags, and the cam position detection sensor 40 provided for the cam 38 for the execution of the rotational positioning of the cam 38, it is arranged to control each of the operations of the respective means described earlier.

Figure 11:
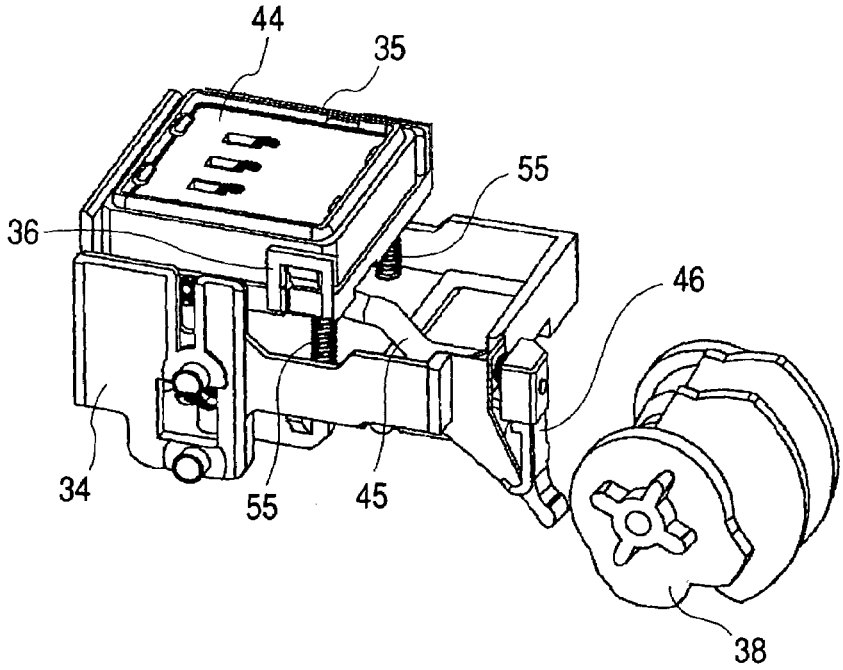
FIG. 11 is a perspective view that shows schematically the state where the air ventilation valve, which constitutes capping means of the discharge recovery device, is closed (the closed condition of the cap).
Figure 12:
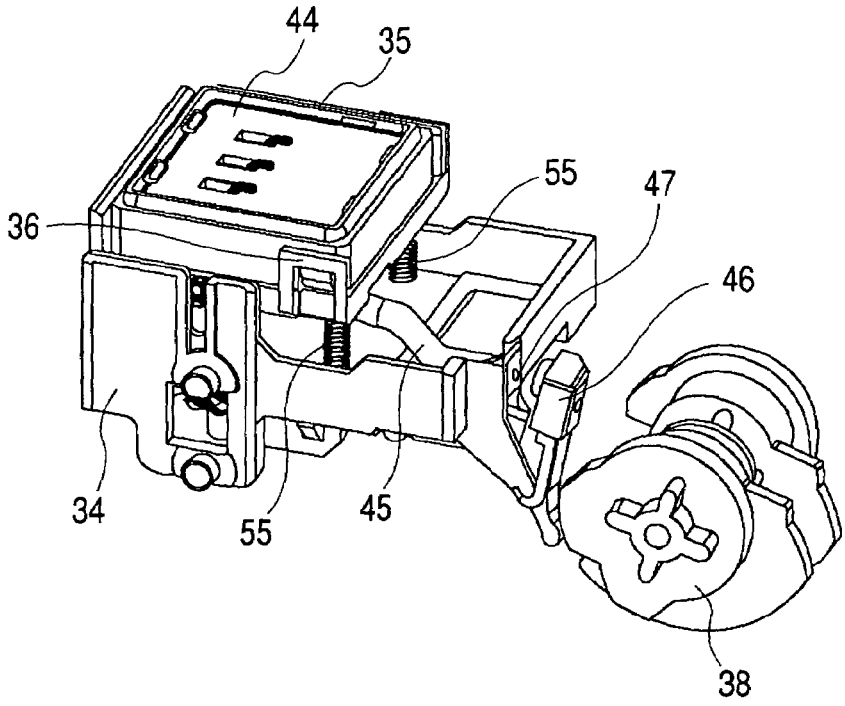
FIG. 12 is a perspective view that shows schematically the released state of the air ventilation valve that constitutes capping means represented in FIG. 11 (roller being in the initial condition).
Figure 13:
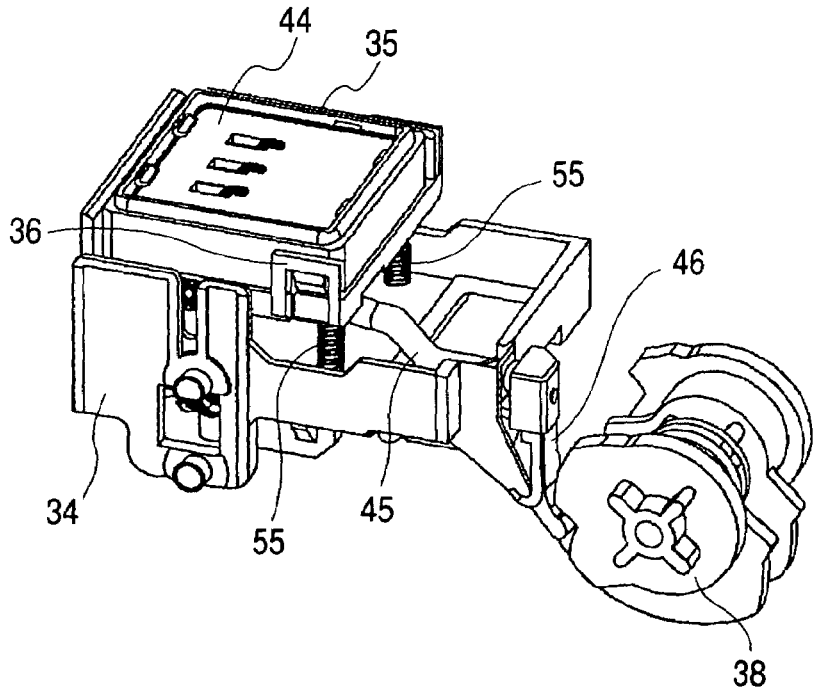
FIG. 13 is a perspective view that shows schematically the closed state of the air ventilation valve that constitutes capping means represented in FIG. 11 (the sucking condition).
Figure 14:
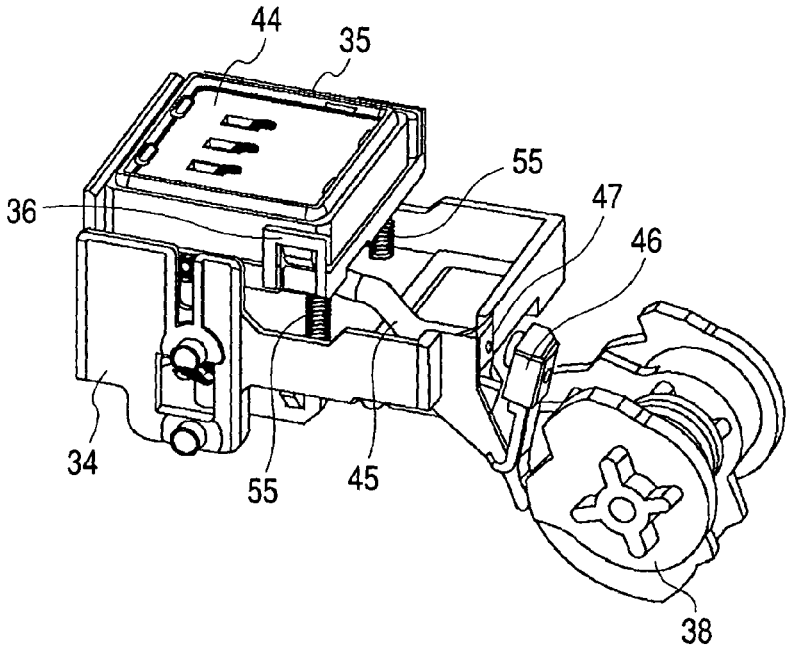
FIG. 14 is a perspective view that shows schematically the released state of the air ventilation valve that constitutes capping means represented in FIG. 11 (the condition of idle suction).
Figure 15:
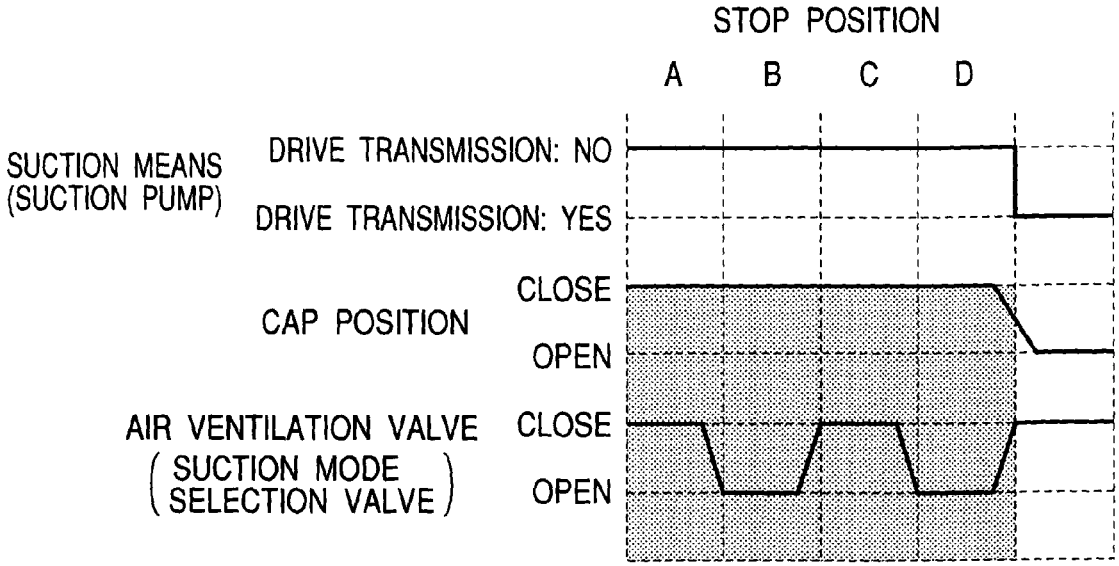
FIG. 15 is a view that shows schematically the brief timing chart of the cap and the air ventilation valve of capping means that constitutes the discharge recovery device, and suction means at the time of selecting suction modes.

As shown in FIGS. 11 to 15, the air ventilation hole 47 is opened and closed depending on the positions of the air ventilation valve 46, thus controlling the release of the air tightness inside the cap 35. FIG. 11 shows the position of the valve when capping is made to protect the discharge port surface of the recording head 3. FIG. 12 shows the position of the valve when the inside of the cap 35 is conditioned to be communicative with the air outside for the preparation of the suction recovery operation, and when the idle suction is executed in order to exhaust ink in the cap 35. FIG. 13 shows the position of the valve when suction is made in accordance with the present embodiment. The valve operations described here are executed also by use of one power source, that is, the PG motor M3 provided for the discharge recovery device of the present embodiment, and the closing operation of the air ventilation valve should be attained without affecting the status of the pressure rollers 33, which is conditioned for the preparation of the suction recovery operation. Therefore, as shown in FIG. 15, the structure is arranged so as not to allow the pump gear trigger ribs 42*a* and 42*b*, which are provided for the pump gear 27, to abut against the pump gear trigger boss 41 provided for the end face of the pressure roller guide 30 that forms suction means 48, thus transmitting no driving power of the PG motor M3 to the suction means 48 side when capping means 11 is in contact with the recording head 3 during which the driving power of the PG motor M3 is transmitted to the one-way clutch gear 28 for the rotation of the cam 38 to enable the air ventilation valve 46 to operate. Here, in FIG. 15, the mesh portion indicates the area where no driving power is transmitted to the suction pump side (that is, within the cam driving range on the suction mode-selected side), and as to the cam positions, the reference marks indicate:

A: the recovery system HP (valve closed)

B: the initialization of the pump rollers (valve released)

C: suction (valve closed)

D: idle suction (valve released).

In other words, the structure is arranged so that in a status where the driving power of the PG motor M3 is transmitted to the cam 38 side, the transmission thereof to suction means 48 is released during the opening and closing operation of the air ventilation tube (the netted portion in FIG. 15). Consequently, the gap between the pump gear trigger ribs 42*a* and 42*b* provided for the pump gear 27 is established so as not to allow the driving power of the PG motor M3 to be transmitted to the suction means 48 side in the mesh portion indicated in FIG. 15 in consideration of the rotational angle of the cam 38, the gear speed reduction ratio in the transmission from the PG motor M3 to suction means 48, and the gear speed reduction ratio in the transmission to the cam 38 in the area of the opening and closing operation of the air ventilation valve. After suction, the PG motor M3 rotates in the direction in which the driving power thereof is transmitted to the suction means 48 side in order to execute the suction recovery operation, thus executing the suction recovery for sucking a designated amount of ink. Subsequently, in order to exhaust from the cap 35 the waste ink sucked into the cap 35, the cam 38 rotates to enable the air ventilation valve 46 to be released as shown in FIG. 14. Here, should the driving power be transmitted to suction means 48 during the opening operation of the air ventilation tube, the pressure roller 33 is caused to rotate in the direction in which the suction tube 32 is allowed to reverse the flow of ink into the cap 35 eventually. In such case, the recording head may be damaged by the reverse flow of ink. However, in the present invention, the structure is arranged so that during the aforesaid operation, too, the pump gear trigger ribs 42*a* and 42*b* of the pump gear 27 are driven to rotate in the direction in which these ribs part from the contact with the pump gear trigger boss 41 on the pressure roller guide 30. As a result, suction means 48 is not allowed to rotate, and there is no possibility that any drawback takes place due to the reverse flow of ink. After the air ventilation valve 46 is put in the aforesaid status, suction means 48 executes the idle suction operation for exhausting ink in the cap 35 out of the discharge recovery device by the driving power transmitted from the PG motor M3 in the direction in which the suction recovery operation is made executable. Thus, the general suction recovery operation terminates.

Figure 5:
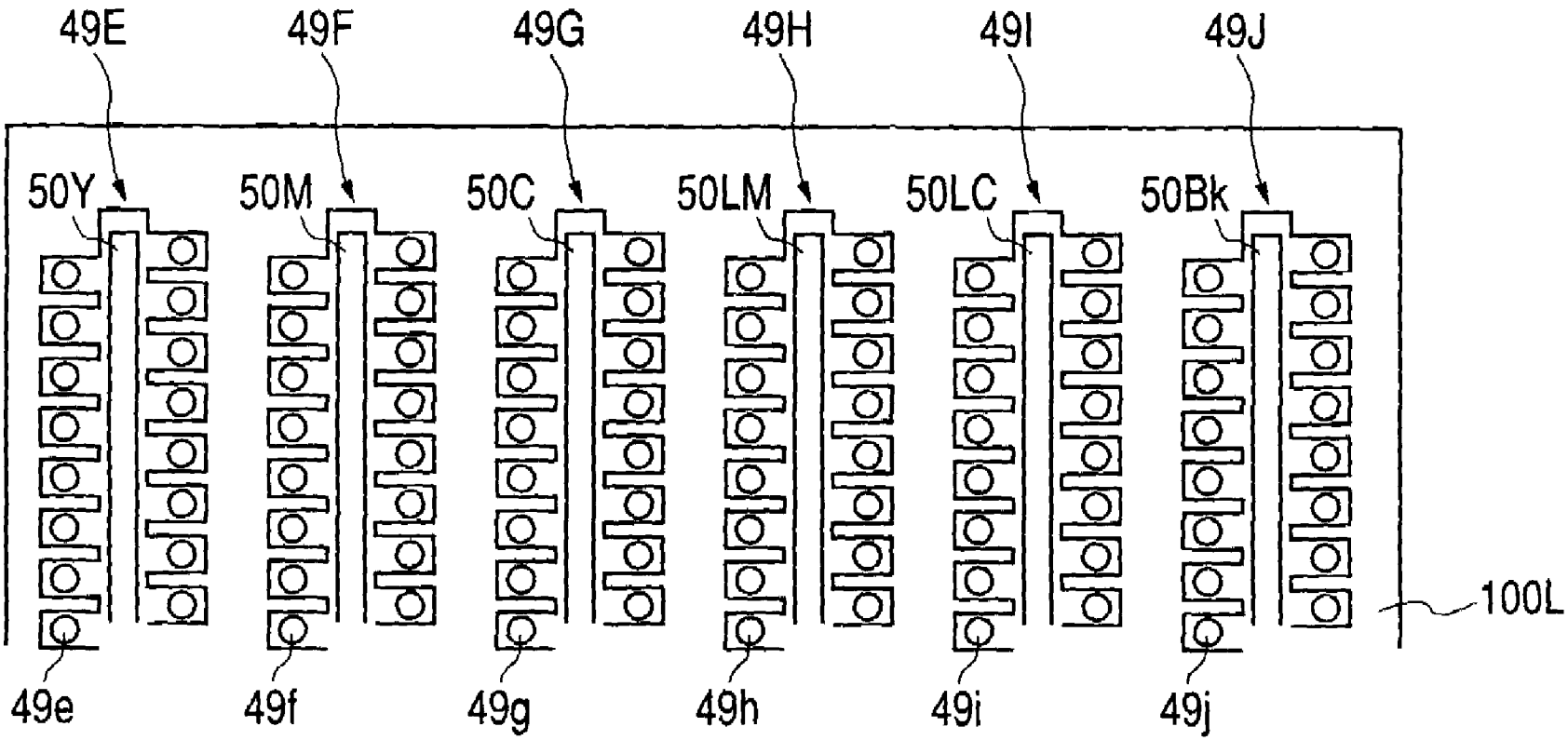
FIG. 5 is a side view that schematically shows a discharge port plate.

FIG. 5 shows partly the structure of the recording head 3 of the present embodiment. There are formed on the discharge port plate 100L the discharge port group 49E for use of yellow ink, the discharge port group 49F for use of magenta color ink, the discharge port group 49G for use of cyan color ink, the discharge port group 49H for use of light magenta color ink, the discharge port group 491 for use of light cyan color ink, and the discharge port group 49J for use of black color ink, in that order. Each of the discharge port groups 49E to 49J is provided with two arrays of 256 discharge ports 49*e* to 49*j* per array, and communicated with each of the common liquid chambers 50Y to 50Bk in the state where these are arranged in two arrays. The discharge ports are arranged at intervals of 600 dpi per line of discharge ports. However, it is arranged to displace the arrangement pitches of two lines by half a pitch in the arrangement direction thereof. Therefore, the arrangement pitches appear to be at intervals of 1,200 dpi.

FIG. 6 is the table that shows preliminary discharge operations of the ink jet recording apparatus in accordance with the present embodiment. The preliminary discharges A1 to A3 comprise the preliminary discharge mode executable when the cap is open in order to eliminate scratches at the initial stage of recording due to the evaporation of ink from the discharge ports of the recording head in the capped condition. Different preliminary discharge modes are adopted for execution depending on the time that has elapsed since the last capping. In accordance with the present embodiment, the mode A1 is selected if the time that has elapsed from the last capping is equal to or longer than 0 hour, but shorter than 12 hours, and 500 shots of preliminary discharges are made toward the cap away from the discharge port surface. Also, if the time that has elapsed is equal to or longer than 12 hours, but shorter than 24 hours from the last capping, the mode A2 is selected, and 700 shots of preliminary discharges are made toward the cap away from the discharge port surface. Also, if the time that has elapsed is longer than 24 hours from the last capping, the mode A3 is selected, and 1,000 shots of preliminary discharges are made toward the cap away from the discharge port surface.

The preliminary discharges B1 and B2 comprise the preliminary discharge mode executable at predetermined time intervals during the recording operation or during the suspension period of recording in order to eliminate scratches of recorded images due to the evaporation of ink from the discharge ports of the recording head during the recording operation or during the period of suspension thereof, and also, to eliminate the increase of density. In accordance with the present embodiment, 9 shots of preliminary discharges are made toward a preparatory port (may be referred to as the ink receiving portion) or the cap away from the discharge port surface per 0.9 second that has elapsed from the previous preliminary discharge. If the time has elapsed 0.9 second from the previous preliminary discharge during the scanning operation, the preliminary discharge is executed after the completion of the scanning operation in this particular case. Here, if any preliminary discharge is needed in a position other than that of capping means 11, the preliminary discharge is executed toward the preliminary discharge port.

The preliminary discharge mode C is the one to be executed after the wiping operation in order to eliminate the degradation of recording quality that may take place when ink adhering to the discharge port surface is driven into the discharge ports by the execution of the wiping operation and recording is made with ink mixed in the discharge ports. For the present embodiment, 500 shots of preliminary discharges are made toward the cap away from the discharge port surface after the execution of the wiping operation.

The preliminary discharge mode D is the one to be executed after the suction operation in order to eliminate the mixed colors in the recording images that may take place due to the reverse flow of ink of mixed colors by the execution of the suction operation. In accordance with the present embodiment, 20,000 shots of preliminary discharges are made in the capped condition subsequent to the suction operation. In this way, it becomes possible to suppress the generation of mist by the execution of preliminary discharges. At this juncture, the discharge frequency of preliminary discharge mode D is set lower than that of other preliminary discharge modes so as to make the exhausting speed of ink that has been discharged into the cap sufficiently faster than the speed at which ink as discharged is filled in the cap. Also, in accordance with the present embodiment, there is a fear that ink preliminarily discharged into the cap is filled in the cap and is allowed to be in contact with the discharge port surface. Therefore, the so-called idle suction operation is executed in the state where the air ventilation valve is released. Then, the preliminary discharges are executed while ink in the cap is being exhausted.

It is possible to suppress the generation of mist if the preliminary discharges are made in the state of the capping being effectuated, but it takes time to carry out the capping operation. Therefore, the structure is arranged so that when the number of preliminary discharges is small, the preliminary discharges are directed to the cap away from the discharge port surface on the assumption that the influence of mist generation then is also small, and that when the number of preliminary discharges is large, the preliminary discharges are made in the state where the capping has been effectuated on the assumption that the influence of mist generation is also large. Consequently, in accordance with the present embodiment, it becomes possible to suppress the drawback that may be caused by the mist generation by the execution of the preliminary discharges by the adoption of plural preliminary discharge modes corresponding to the current condition of the recording apparatus, while minimizing the increase of time needed for recording on a recording medium.

Figure 8:
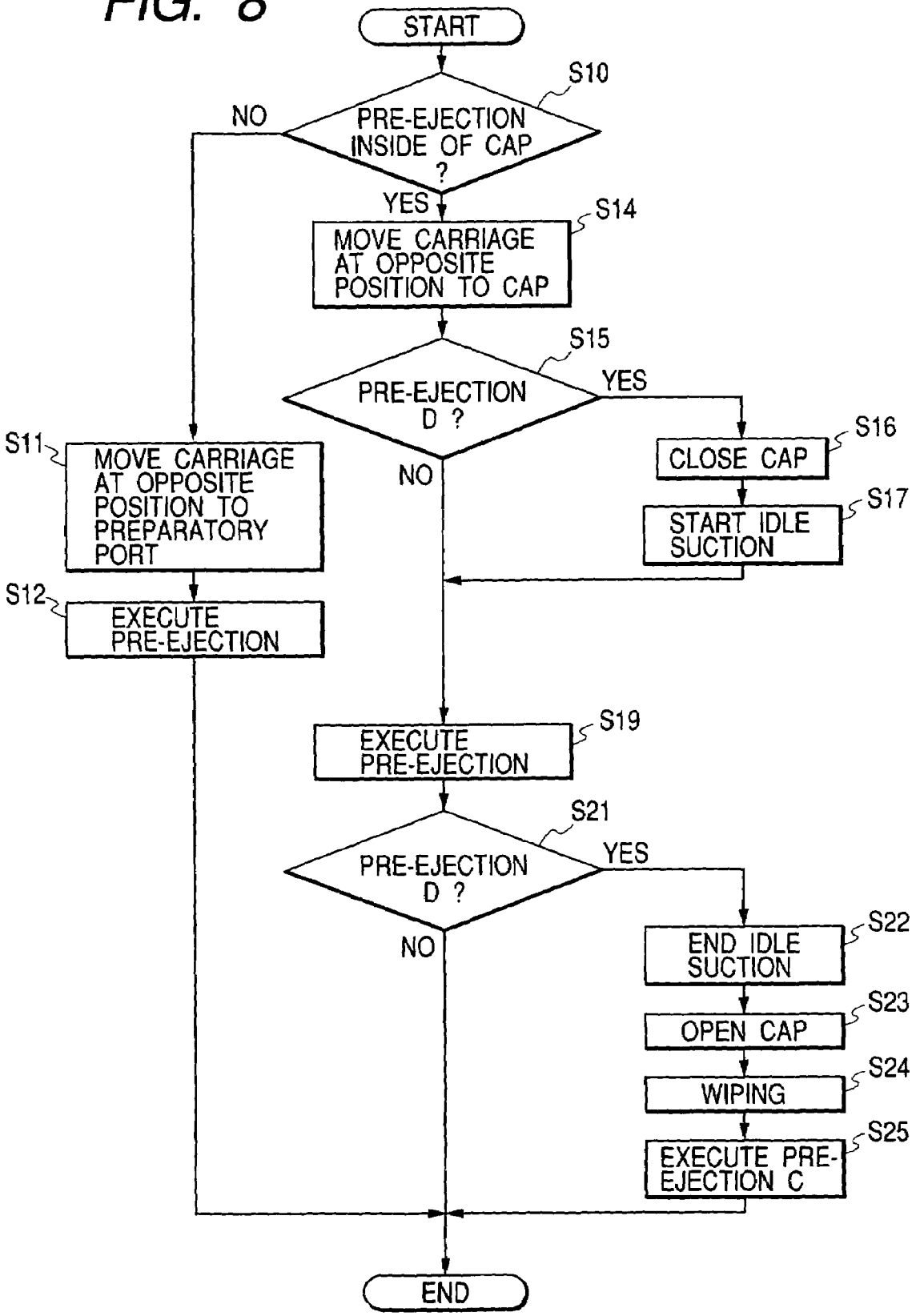
FIG. 8 is a table that indicates a preparatory-discharge sequence in accordance with the first embodiment.

FIG. 8 is a view that shows the operational sequence when preliminary discharges are made in accordance with the present embodiment.

In step S10, a preliminary discharge execution command is issued. Then, it is determined whether the mode of the preliminary discharges is such as to perform them in the cap or toward the preparatory port. The preliminary discharge executable inside the cap means to include the mode in which the preliminary discharges are made toward the cap away from the discharge port surface and the mode in which the preliminary discharges are made in the cap in the capping status.

In step S10, if it is found to be the mode in which the preliminary discharges are made toward the preparatory port (ink receiving portion), that is, the preliminary discharges B1 and B2, and further, the preliminary discharges are made toward the preparatory ports, the carriage 2 moves to the position facing the preparatory port in step S11. After that, in step S12, a predetermined number of preliminary discharges are performed toward the preparatory port. Then, the preliminary discharge process terminates.

Also, in step S10, if it is found to be the mode in which the preliminary discharges are made in the cap, the carriage 2 moves to the position facing the cap in S14. Then, in step S15, it is determined whether or not the preliminary discharge mode is the preliminary discharge D. In the step S15, if it is found that the mode is not the preliminary discharge D, the predetermined number of preliminary discharges is executed in step S19.

Also, in step S15, if the mode of the preliminary discharges is found to be the preliminary discharge D, the capping operation (to close the cap) is performed to enable the cap to be in contact in step S16. In accordance with the present embodiment, when preliminary discharges are made in the cap in the mode of the preliminary discharge D, the idle suction operation begins in step S17 in order to prevent ink from being filled in the cap during the preliminary discharges and being in contact with the discharge port surface or prevent the occurrence of any drawback, such as clogging of the discharge ports. Then, in step S119, the predetermined number of preliminary discharges is executed.

Next, in step S21, it is determined whether or not the mode of preliminary discharges is the preliminary discharge D. If it is found in step S21 that the mode of the preliminary discharges is not the preliminary discharge D, the preliminary discharge process terminates.

Also, in step S21, if the mode of preliminary discharges is found to be the preliminary discharge D, the idle suction operation terminates in step S22. Here, in accordance with the present embodiment, the structure is arranged so that when the preliminary discharges terminate in step S19, the idle suction operation in step S22 terminates after 0.5 second has elapsed. This is because ink discharged into the cap by the preliminary discharges should be exhausted sufficiently. Next, in step S23, the operation is performed to enable the cap to retract (to open the cap). Then, in step S24, the wiping operation is executed because the preliminary discharges are made in the cap in the capping status, which may allow the rebounded mist, which is rebounded ink from the cap, to adhere to the discharge port surface. Next in step S25, the preliminary discharge C is executed, and the preliminary discharge process terminates.

In this respect, for the operational sequence shown in FIG. 8, it may be possible to arrange the processes from steps S16 to S17, the executing process of preliminary discharges, and the process from steps S22 to S25 as a series of operations. In such a case, the process in step S21, that is, whether or not the mode of the preliminary discharges is the preliminary discharge D, can be omitted.

SECOND EMBODIMENT

FIG. 7 is a table of the preliminary discharge operations of an ink jet recording apparatus in accordance with a second embodiment of the present invention. What differs from the first embodiment is that the preliminary discharges A2 and A3 do not perform the preliminary discharges in the cap away from the discharge port surface, but perform them in the cap in the capping status.

The present embodiment is characterized to make the arrangement for increasing the mode in which the preliminary discharges are made in the cap in the capping status where the cap is in contact, in addition to the preliminary discharge D, so as to suppress the generation of mist more than the first embodiment.

Figure 9:
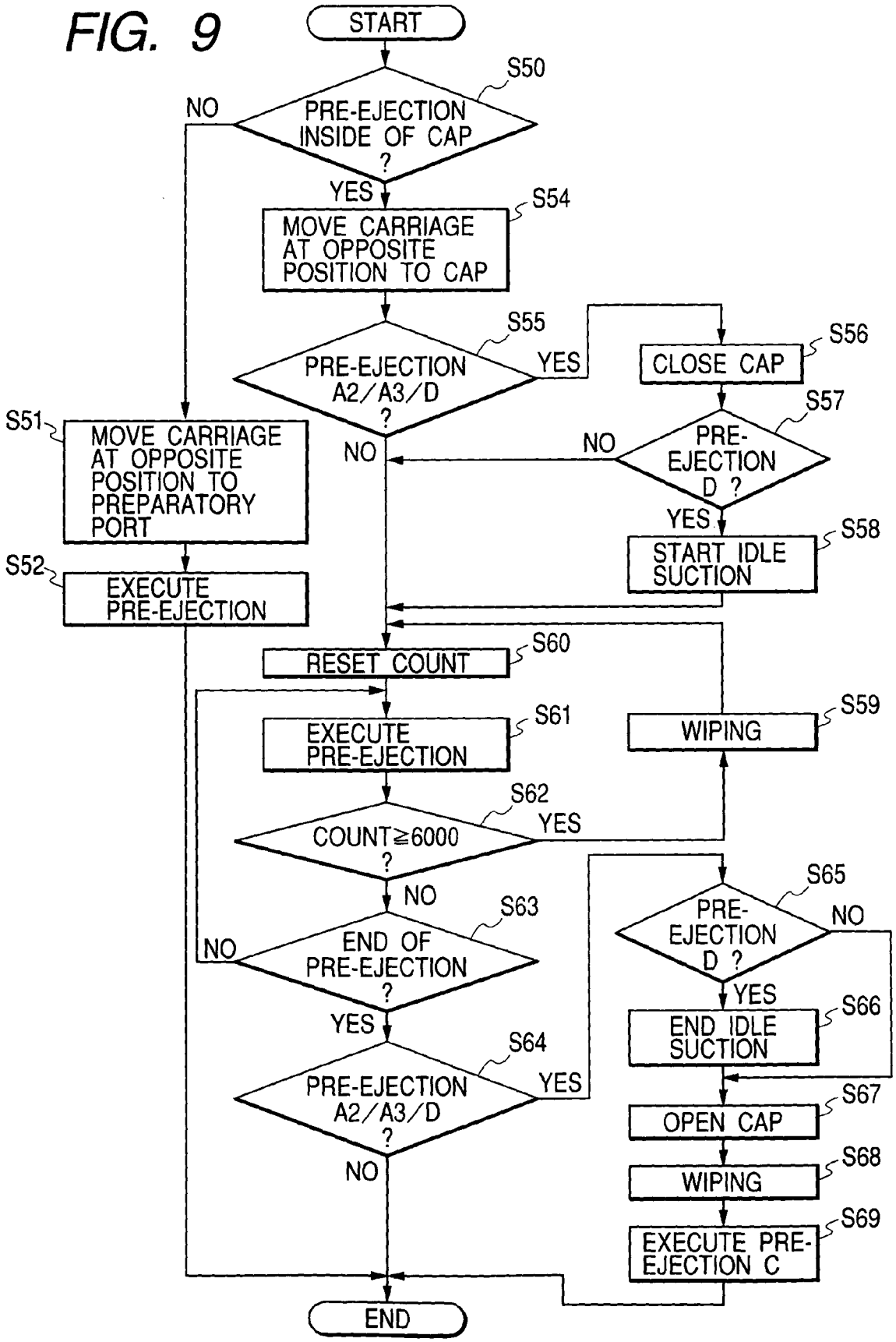
FIG. 9 is a table that indicates a preparatory-discharge sequence in accordance with the second embodiment.

FIG. 9 is a view that shows the operational sequence when preliminary discharges are made in accordance with the present embodiment.

In step S50, a preliminary discharge execution command is issued. Then, it is determined whether the mode of the preliminary discharges is such as to perform them in the cap or toward the preliminary discharge port. The preliminary discharge executable inside the cap means to include the mode in which the preliminary discharges are made toward the cap away from the discharge port surface and the mode in which the preliminary discharges are made in the cap in the capping status.

In step S50, if it is found to be the mode in which the preliminary discharges are made toward the preliminary discharge ports, that is, the preliminary discharges B1 and B2, and further, the preliminary discharges are made toward the preliminary discharge ports, the carriage 2 moves to the position facing the preparatory port (ink receiving portion) in step S51. After that, in step S52, a predetermined number of preliminary discharges are performed toward the preparatory port. Then, the preliminary discharge process terminates.

Also, in step S50, if it is found to be the mode in which the preliminary discharges are made in the cap, the carriage 2 moves to the position facing the cap in step S54. Then, in step S55, it is determined whether or not the preliminary discharge mode is any of the preliminary discharges A2, A3, and D. In step S55, if it is found that the mode is not any of the preliminary discharges A2, A3, and D, that is, it is found to be the preliminary discharge A1, B1, B2 or C, the process in step S60 is executed.

In step S55, if the mode of the preliminary discharges is found to be the preliminary discharges A2, A3, or D, the capping operation (to close the cap) is performed to enable the cap to be in contact in step S56. However, if the preliminary mode is found to be preliminary discharge A2 or A3, it is possible to omit the capping operation because the cap has already been in the closed status. Then in step S57, it is determined whether or not the mode of preliminary discharges is the preliminary discharge D. In step S57, if the mode of preliminary discharges is found to be the preliminary discharge D, the idle suction operation begins in step S58 in order to prevent ink from being filled in the cap during the intended preliminary discharges in the cap, and prevent it from being in contact with the discharge port surface or prevent the occurrence of any drawback, such as to clog the discharge ports. Also, in step S57, if it is found that the preliminary discharge mode is not preliminary discharge D, that is, the preliminary mode is determined to be preliminary discharge A2 or A3, the process in step S60 is executed.

Next, in step S60, the counted value of the preliminary discharge numbers is reset, and in step S61, the intended preliminary discharges are executed. Here, in accordance with the present embodiment, the structure is arranged so that when the mode of preliminary discharges is the preliminary discharge D, the preliminary discharges in step S61 are executed after 0.5 second has elapsed since the beginning of the idle suction operation in step S58. Next, in step S62, it is determined whether or not the counted vale of the preliminary discharge is 6,000 or more. In step S62, if the counted value thereof is found to be 6,000 or more, the rebounded mist, which is the rebounded ink from the cap, adheres to the discharge port surface, because the preliminary discharges are performed in the cap in the capping status. Therefore, in step S59, the wiping operation is performed, and the process in step S60 is executed. Also, in step S62, if the counted value of preliminary discharge numbers is found to be less than 6,000, it is determined in step S63 whether or not the preliminary discharges terminate. If the preliminary discharges do not terminate, the process in step S61 is executed.

In step S63, if the preliminary discharges are found to have terminated, it is determined in step S64 whether or not the mode of preliminary discharge is any of the preliminary discharges A2, A3, and D. In step S64, if the mode of preliminary discharges is not any of the preliminary discharges A2, A3, and D, that is, the preliminary discharge is found to be preliminary discharge A1, B1, B2, or C, the preliminary discharge process terminates.

In step S64, if it is found that the mode of preliminary discharges is any of preliminary discharge A2, A3 and D, it is determined in step S65 whether or not the mode of preliminary discharge is the preliminary discharge D. In step S65, if the mode of preliminary discharges is the preliminary discharge D, the idle suction operation terminates in step S66. Here, in accordance with the present embodiment, the structure is arranged so that the idle suction operation in step S66 terminates after 0.5 second has elapsed since the termination of the preliminary discharge in step S61. This is arranged in order to enable the ink, which has been discharged into the cap by the preliminary discharges, to be exhausted sufficiently. Also, in step S65, if it is found that the mode of preliminary discharge is not the preliminary discharge D, that is, if it is determined that the preliminary discharge is preliminary discharge A2 or A3, the process in step S67 is executed.

Next, in step S67, the operation to put the cap apart (cap opening operation) is executed. Then, since the preliminary discharges are executed in the cap in the capping status, the rebounded mist, which is the rebounded ink from the cap, adheres to the discharge port surface. Therefore, in step S68, the wiping operation is executed. Next, in step S69, the preliminary discharge C is performed, thus terminating the preliminary discharge process.

As in the first embodiment, the structure is arranged so that when the number of preliminary discharges is small, the preliminary discharges are directed to the cap away from the discharge port surface on the assumption that the influence of mist generation then is also small, and that when the number of preliminary discharges is large, the preliminary discharges are made in the state where the capping has been effectuated on the assumption that the influence of mist generation is also large. Consequently, in accordance with the present embodiment, too, it becomes possible to suppress the drawback that may be caused by the mist generation by the execution of the preliminary discharges by the adoption of plural preliminary discharge modes corresponding to the current condition of the recording apparatus, while minimizing the increase of time needed for recording on a recording medium.

What is claimed is:

1. An ink jet recording apparatus for performing image formation on a recording medium by using a recording head having plural discharge ports being arranged to discharge ink from the discharge ports, comprising:

preliminary discharging means for performing preliminary discharges by discharging ink from the discharge ports irrespective of the image formation;

capping means for enabling a cap for capping the plural discharge ports to be in contact with and retract from a discharge port surface of the recording head where the discharge ports are formed;

selection means for selecting whether the preliminary discharges are to be performed in the status of having said cap be in contact with the discharge port surface or in the status of having said cap be retracted from the discharge port surface, according to the number of ink discharges by said preliminary discharging means; and suction means for sucking the ink in said cap by generating negative pressure in said cap, wherein when the preliminary discharges are performed in the status of having said cap in contact, said cap is communicated with the air outside, and suction is also effectuated by said suction means, wherein the ink discharge number in the status of having said cap in contact is selected to be greater than the ink discharge number in the status of having said cap retracted, wherein the discharge frequency in performing the suction and the preliminary discharges is lower than the discharge frequency in performing only the preliminary discharges.

2. An ink jet recording apparatus for performing image formation on a recording medium by using a recording head having plural discharge ports being arranged to discharge ink from the discharge ports, comprising:

preliminary discharging means for performing preliminary discharges by discharging ink from the discharge ports irrespective of the image formation;

capping means for enabling a cap for capping the plural discharge ports to be in contact with and retract from a discharge port surface of the recording head where the discharge ports are formed; and selection means for selecting whether suction by suction means and the preliminary discharges are to be performed in the status of having said cap be in contact with the discharge port surface and having the inside of said cap communicated with the air outside, the preliminary discharges are to be performed in the status of having said cap be in contact with the discharge port surface, or the preliminary discharges are to be performed in the status of having the cap be retracted from the discharge port surface, according to the number of ink discharges by said preliminary discharging means, wherein the ink discharge number of the suction and the preliminary discharges being performed in the status of having said cap in contact is selected to be greater than the ink discharge number of the preliminary discharges being performed in the status of having said cap in contact, and the ink discharge number of the preliminary discharges being performed in the status of having said cap in contact is selected to be greater than the ink discharge number in the status of having said cap retracted.

3. An ink jet recording apparatus according to claim 2, wherein when the preliminary discharges are to be performed in the status of having said cap retracted, the preliminary discharges are performed toward said cap or the preliminary discharges are performed toward an ink receiving portion other than said cap.

4. An ink jet recording apparatus according to claim 2, wherein when the suction and the preliminary discharges are performed, the suction is performed for a designated time in the status of having the inside of said cap communicated with the air outside after the preliminary discharges terminate.

5. An ink jet recording apparatus according to claim 2, wherein when the suction and the preliminary discharges are performed, the suction is performed for a designated time in the status of having the inside of said cap communicated with the air outside before the preliminary discharges begin.

6. An ink jet recording apparatus according to claim 2, wherein the discharge frequency in performing the suction and the preliminary discharges is lower than the discharge frequency in performing only the preliminary discharges.

7. An ink jet recording apparatus according to claim 2, further comprising wiping means for wiping off the ink adhering to the discharge port surface, wherein when a predetermined number of preliminary discharges is executed by said preliminary discharging means, said wiping means wipes off the ink adhering to the discharge port surface.

* * * * *